US005139382A

United States Patent [19]

Honma et al.

[11] Patent Number: 5,139,382

[45] Date of Patent: Aug. 18, 1992

[54] APPARATUS FOR LIFTING AND LOWERING SEAMING HEAD IN CAN END SEAMING MACHINE

[75] Inventors: Toru Honma, Ohmiya; Izumi Matsushita, Koshigaya; Yoshiteru Kojika, Saitama; Noboru Sasaki, Kitamoto, all of Japan

[73] Assignee: Hokkai Can Co., Ltd., Tokyo, Japan

[21] Appl. No.: 723,908

[22] Filed: Jul. 1, 1991

[30] Foreign Application Priority Data

Jul. 2, 1990 [JP] Japan ..... 2-175558

[51] Int. Cl.[5] ..... B21D 51/26

[52] U.S. Cl. ..... 413/43; 413/27

[58] Field of Search ..... 413/27, 31, 36, 37, 413/43; 53/75, 331, 334, 486; 72/19, 21, 22

[56] References Cited

U.S. PATENT DOCUMENTS

| | | | |
|---|---|---|---|
| 796,927 | 8/1905 | McGinnis | 413/37 |
| 1,209,233 | 12/1916 | Troyner | 413/44 |
| 2,392,728 | 1/1946 | Diezel | 413/44 |
| 3,030,900 | 4/1962 | Munschauer et al. . | |
| 3,910,212 | 10/1975 | Konoki | 413/27 |

FOREIGN PATENT DOCUMENTS

| | | |
|---|---|---|
| 0302936 | 2/1989 | European Pat. Off. . |
| 1561963 | 4/1969 | France . |

*Primary Examiner*—Bruce M. Kisliuk
*Assistant Examiner*—Jack Lavinder

[57] ABSTRACT

A can end double-seaming machine has a seaming head vertically movably mounted on a base and supporting a seaming chuck and a seaming roll. The seaming head is guided for its vertical movement by support posts on the base. Rotors are rotatably threaded on the support posts and rotatable by a motor for lifting and lowering the seaming head. A controller controls the motor to elevate the seaming head upwardly of a predetermined seaming position, then lower the seaming head downwardly of the seaming position, and thereafter elevate the seaming head to the seaming position, thereby positioning the seaming head in the seaming position. Since the seaming head is lowered downwardly of the seaming position and then lifted back to the seaming position, the seaming head is reliably and accurately be brought into the seaming position without a positional error which would otherwise be caused by the backlash between the rotors and the support posts.

5 Claims, 4 Drawing Sheets

APPARATUS FOR LIFTING AND LOWERING SEAMING HEAD IN CAN END SEAMING MACHINE

BACKGROUND OF THE INVENTION

1. Field of the Invention

The present invention relates to a can end seaming machine for double-seaming a can end on a can body, and more particularly to an apparatus for automatically lifting and lowering a seaming head into a can end seaming position when a seaming chuck and a seaming roll are to be set in place on the seaming head in a can end double-seaming machine which double-seams a can end on a can body that has been filled with contents such as a beverage, thus producing a sealed can.

2. Description of the Prior Art

Canned foods or beverages are generally prepared either by filling a can body with a processed food or beverage material, deaerating the can body, closing and sealing the filled can body with a can end, and then sterilizing the can, or by filling a can body with a sterilized food or beverage material in a sterilized environment, deaerating the can body, and closing and sealing the can body with a sterilized can end. The cans which have been produced in either of the above processes can be stored for a long period of time.

Sealing can bodies with can ends is effective in fully preventing entry of microorganisms, air, and water into cans for protecting the canned foods or beverages against modification or deterioration of properties. Therefore, the can body sealing process is as important as the deaerating and sterilizing processes in making canned foods or beverages resistant to changes in long-term storage.

Normally, a can body is sealed when a can end is double-seamed on the can body by a double end seamer or seaming machine. There are known various double end seaming machines with different processing capabilities and different seaming mechanisms. However, any double end seaming machines are composed mainly of a lifter, a seaming chuck, and a seaming roll which make up a seaming mechanism.

The lifter holds the bottom end of a can body. When a can body filled with contents and carrying a can end is supplied onto the lifter, the lifter is elevated until the can end is held by seaming chuck which is positioned above the lifter. The can end is fitted in and pressed against the can body by the seaming chuck. The can end and the can body are now securely held by the seaming chuck and the lifter. While the can end is being seamed, the lifter serves as a cushion for pressing the can end and the can body against the seaming chuck under a certain degree of resiliency. Adjusting the lifter cushion resiliency plays a vital role in adjusting the strength with which the can end is seamed on the can body.

The seaming chuck is held in intimate contact with the can end in the can end double seaming machine. During the seaming process, the seaming chuck holds the can end and the can body in cooperation with the lifter, and is simultaneously subjected to the pressure from the seaming roll.

The seaming roll comprises a first seaming roll and a second seaming roll. The first and second seaming rolls have respective grooves of different contours. Generally, the groove of the first seaming roll is narrower and deeper, and the groove of the second seaming roll is wider and shallower.

The lifter, the seaming chuck, and the seaming roll (first and second seaming rolls) coact to overlap and bend a flange of the can body and a curl of the can end until the end curl is fully tucked up beneath the body flange. The sealing of the seamed structure is enhanced by a sealing compound applied between the end curl and the body flange.

Depending on the processing capacity of the can end double seaming machine, the lifter, the seaming chuck, and the seaming roll are adjustably positioned relatively to each other to make it possible to double-seam can ends of various cans having different diameters and heights or lengths.

Various factors which affect the double-seaming of cans include the thickness and temper of can sheets such as of tin, aluminum, the contours of the seaming roll grooves, the gradient of the seaming chuck, the configurations of the end curl and the body flange, and the coated conditions of the sealing compound, among other things. The most influential element is the adjustment of a relative positional relationship between the seaming roll, the lifter, and the seaming chuck, and a lot of skill is required to carry out such positional adjustment.

More specifically, in order to double-seam a can end on a can body with a can end double seaming machine, it is necessary that a seaming check and a seaming roll, which match the can end and the can body to be seamed together, be set on a seaming head that is vertically mounted on a base, and the seaming head be positioned into conformity with the height of the can body on a lifter placed on the base. To meet the above requirement, the seaming head with the seaming chuck and the seaming roll set thereon is vertically movable with respect to the lifter on the base.

The seaming head can be vertically moved, i.e., lifted and lowered, by a rotor rotatably threaded in a threaded hole which is defined in an upper portion of a support column that is vertically mounted on the base, and a manually operable handle operably coupled to the rotor through a gearing for rotating the rotor.

To set the seaming chuck and the seaming roll on the seaming head, the handle is manually turned to rotate the rotor for thereby elevating the seaming head. Then, the seaming chuck and the seaming roll are mounted on the seaming head as desired. Thereafter, the handle is manually turned again to lower the seaming head into a desired seaming position.

At this time, the lifter on the base and the seaming chuck and the seaming roll set on the seaming head should be spaced apart at a highly accurate distance corresponding to the height or length of the can body on which the can end is to be seamed. The gear ratio of the gearing is selected such that the seaming head is vertically moved a relatively small distance in response to one revolution of the handle. Consequently, the vertical movement of the seaming head can be finely adjusted by the handle. When lowering the seaming head to the desired seaming position, the handle is turned to finely adjust the vertical position of the seaming head while measuring the distance between the lifter and the seaming chuck and the seaming roll with a microgage or the like.

However, the use of the manually operable handle to lift or lower the seaming head into the desired seaming position is disadvantageous in that it takes a long period of time to reach the desired seaming position because the distance that the seaming head moves per revolution of the handle is considerably small, and also in that the adjustment of the seaming head position needs a skillful operator.

While modern can end double-seaming machines operate at high speed for increased productivity, the entire process involving the manual positional adjustment is inefficient because it is time-consuming to position the seaming chuck and the seaming roll for double-seaming operation.

SUMMARY OF THE INVENTION

In view of the aforesaid shortcomings of the conventional can end double-seaming machines, it is an object of the present invention to provide an apparatus for automatically lifting and lowering a seaming head in order to set a seaming chuck and a seaming roll on the seaming head, and for positioning the seaming head within a relatively short period of time.

According to the present invention, there is provided an apparatus for lifting and lowering a seaming head in a can end seaming machine which includes a base on which the seaming head is vertically movably mounted, the seaming head supporting a seaming chuck, a support post mounted on the base for guiding the seaming head, and a rotor rotatably threaded on the support post and rotatable for lifting and lowering the seaming head, the apparatus comprising actuating means for rotating the rotor to lift and lower the seaming head, and controlling means for controlling the actuating means to elevate the seaming head upwardly of a predetermined seaming position, then lower the seaming head downwardly of the seaming position, and thereafter elevate the seaming head to the seaming position, thereby positioning the seaming head in the seaming position.

The rotor is rotated by the actuating means to elevate and lower the rotor with respect to the support post, so that the seaming head, vertically movable with the rotor, can be elevated and lowered.

After the seaming head is elevated to an uppermost position by the actuating means, the seaming chuck and the seaming roll are set in place, or mounted, on the seaming head. Then, the actuating means is controlled by the controlling means to lower the seaming head downwardly of the seaming position, and thereafter elevate the seaming head up to the seaming position, in which the seaming head is positioned.

If the rotor were stopped when the seaming head reaches the seaming position on its descending movement, then the seaming head would be displaced slightly from the seaming position because of the backlash between the rotor and the support post. However, since the seaming head is first lowered downwardly of the seaming position and then lifted back to the seaming position, as described above, the seaming head is reliably and accurately be positioned in the seaming position without a positional error that would otherwise result from the backlash.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
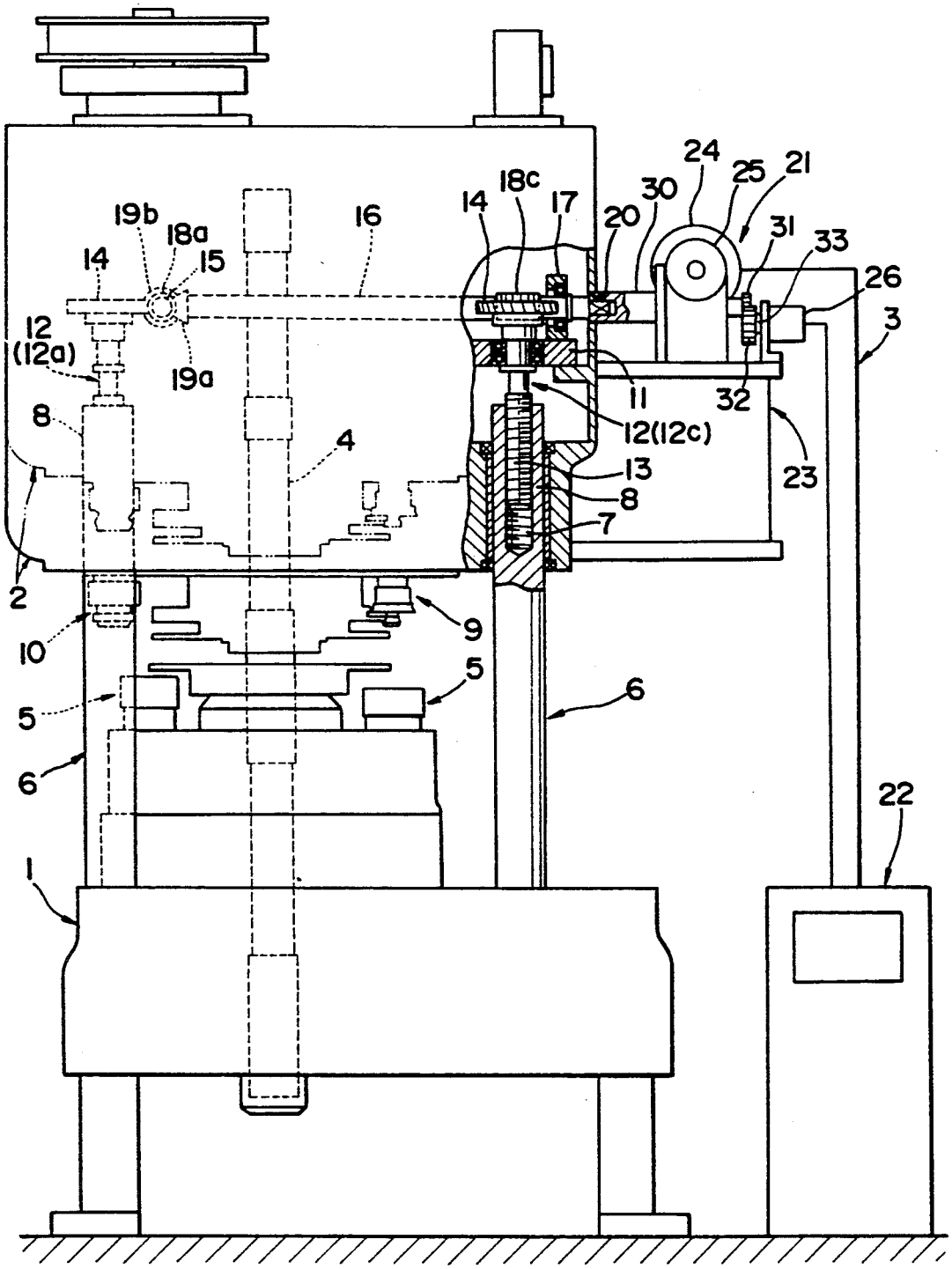
FIG. 1 is a side elevational view, partly in cross section, of a can end double-seaming machine having an apparatus for lifting and lowering a seaming head according to the present invention.

As shown in FIG. 1, a can end double-seaming machine includes a base 1, a seaming head 2 mounted on the base 1, and an apparatus 3 for lifting and lowering the seaming head 2. A vertically extending main shaft 4 has a lower end portion inserted in and fixed to a substantially central potion of the base 1. The main shaft 4 is surrounded by a plurality of lifters 5 that are mounted on the base 1. The base 1 supports thereon a plurality of spaced rod-like support posts 6 positioned at its peripheral edges and extending vertically parallel to the main shaft 4. Each of the support posts 6 has a threaded upper end portion 8 which defines therein a threaded hole 7 extending downwardly from the upper end of the support post 6. There are three support posts 6, for example, which are spaced apart from each other as shown in FIG. 2.

The seaming head 2 has a substantially central portion fitted over an upper end portion of the main shaft 4 in spaced relationship to the base 1. The upper end portions of the support posts 6 are inserted into the seaming head 2 from its lower end. The seaming head 2 is vertically movable along the main shaft 4 and the support posts 6. A seaming chuck 9 and a seaming roll 10 are supported on the lower end of the seaming head 2 at positions around the main shaft 4, the seaming chuck 9 and the seaming roll 10 being directed toward the lifters 5. The other structural details of the can end double-seaming machine are the same as those of the conventional can end double-seaming machines, and will not be shown and described in detail.

Support plates 11 are fixedly mounted in the seaming head 2 directly above the respective support posts 6. Vertically extending rod-like rotors 12 extend respectively through the support plates 11, and are rotatably supported at their upper portions in the support plates 11 concentrically with the support posts 6. The rotors 12 have externally threaded lower end portions 13, respectively, which are threaded in the threaded holes 7 in the respective support posts 6. Therefore, the rotors 12 are threadedly supported at the externally threaded lower end portions 13 by the respective threaded upper end portions 8 of the support posts 6. Worm wheels 14 are fitted over the upper ends of the respective rotors 12 for rotation therewith.

Figure 2:
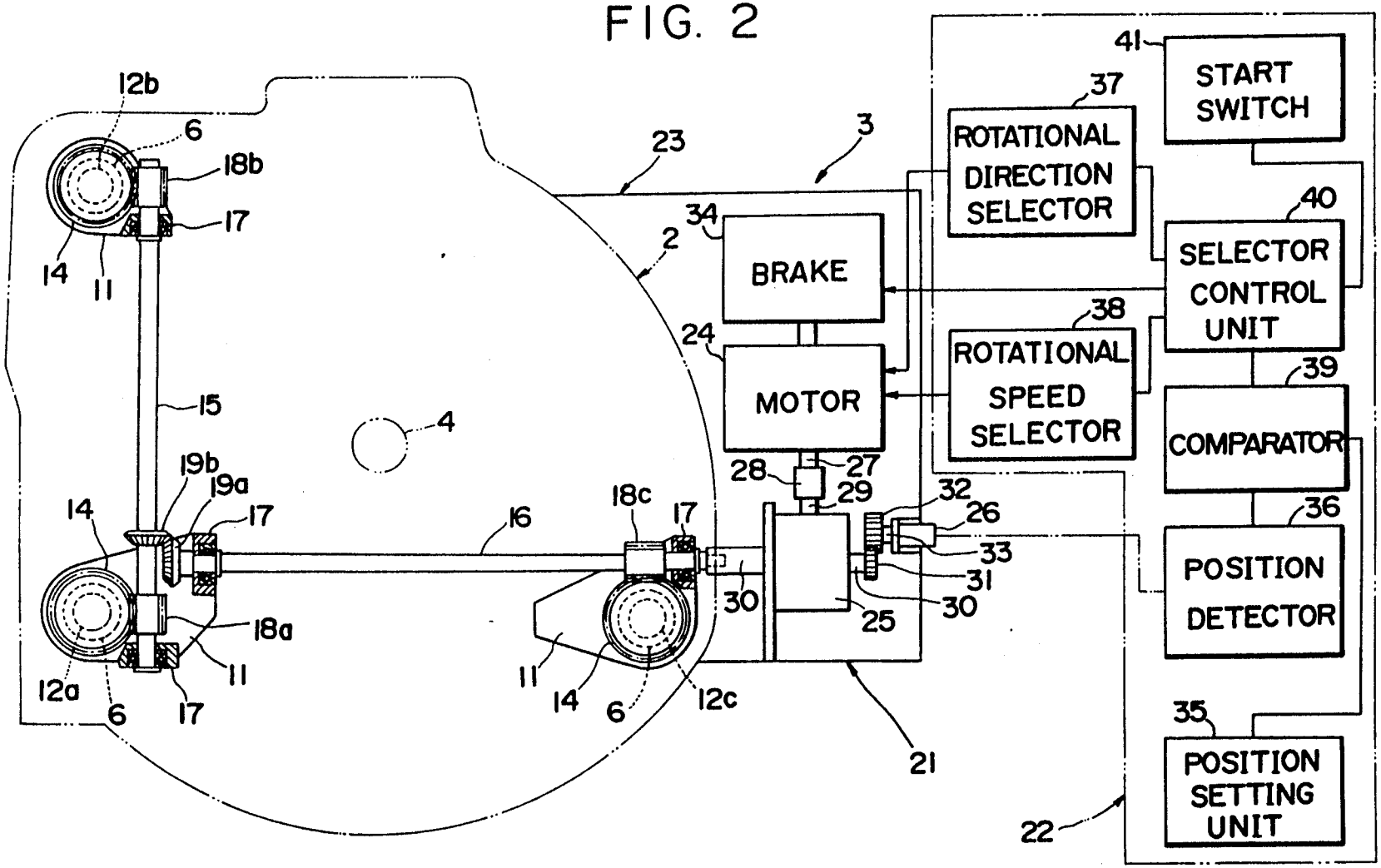
FIG. 2 is a schematic plan view, partly in block form, of the apparatus.

In FIG. 2, the rotors 12 are shown as rotors 12*a*, 12*b*, 12*c*, the rotor 12*a* being centrally positioned between the rotors 12*b*, 12*c*. A rotatable shaft 15 extends horizontally from one side of the worm wheel 14 of the rotor 12*a* toward one side of the worm wheel 14 of the rotor 12*b*. Another rotatable shaft 16 extends horizontally from one side of the worm wheel 14 of the rotor 12*c* perpendicularly toward the rotatable shaft 15. The rotatable shafts 15, 16 are rotatably supported on the support plates 11 by respective bearings 17. The worm wheels 14 of the respective rotors 12a, 12b are held in mesh with worms 18a, 18b, respectively, which are fixedly mounted on respective ends of the rotatable shaft 15 for rotation therewith. The worm wheel 14 of the rotor 12c is held in mesh with a worm 18c which is fixedly mounted on an end of the rotatable shaft 15 for rotation therewith.

A bevel gear 19a is fixedly mounted on the other end of the rotatable shaft 16 for rotation therewith. The bevel gear 19a is in mesh with another bevel gear 19b which is fixedly mounted on the rotatable shaft 15 for rotation therewith, the bevel gear 19b being positioned near the worm 18a.

When the rotatable shaft 16, for example, rotates, the rotors 12 rotate simultaneously. Since the threaded portions 13 of the rotors 12 rotate in the threaded holes 7, the rotors 12 are vertically moved together with the seaming head 2 with respect to the support shafts 6 and hence the base 1.

The end of the rotatable shaft 16 on which the worm 18c is mounted projects out of the seaming head 2 through a hole 20 (see FIG. 1) defined in a side panel of the seaming head 2.

As shown in FIGS. 1 and 2, the seaming head lifting and lowering apparatus 3 has an actuator assembly 21 for lifting and lowering the seaming head 2, and a controller 22 for controlling the actuator assembly 21.

The actuator assembly 21 comprises a reversible motor 24 fixedly mounted on a support base 23 which is secured to the side panel of the seaming head 2 beneath the hole 20, the motor 24 being associated with a brake 34, and a speed reducer 25 coupled to the motor 24. As shown in FIG. 2, the motor 24 has a drive shaft 27 connected to an input shaft 29 of the speed reducer 25 through a coupling 28.

The speed reducer 25 has an output shaft 30 coaxial with the rotatable shaft 16, the output shaft 30 having opposite ends projecting from the casing of the speed reducer 25. The speed reducer 25, which may be of a known structure, serves to reduce the rotational speed of rotative power transmitted from the drive shaft 27 to the input shaft 29, and transmits the rotative power at reduced speed to the output shaft 30. The end of the output shaft 30 which projects toward the rotatable shaft 16 is coupled to the projecting end of the rotatable shaft 16. The other projecting end of the output shaft 30 is connected through a pair of intermeshing gears 31, 32 to a rotary encoder 26 for producing a signal indicative of the vertical position or height of the seaming head 2.

When the motor 24 is energized, its rotative power is transmitted from the drive shaft 27 through the input shafts 29, 30 of the speed reducer 25 to the rotatable shaft 16, thus rotating the rotatable shaft 16 about its own axis thereby to lift or lower the seaming head 2.

In order that the height of the seaming head 2 can be detected, the rotary encoder 26 generates a signal each time the output shaft 30 rotates a predetermined angle, i.e., the seaming head 2 vertically moves a predetermined distance.

As shown in FIG. 2, the controller 22 comprises a position setting unit 35 for presetting a height or vertical position for the seaming head 2, a position detector 36 for detecting the height or vertical position of the seaming head 2, a rotational direction selector 37 for selectively rotating the output shaft 27 of the motor 24 in normal and reverse directions, a rotational speed selector 38 for selectively rotating the output shaft 27 at higher and lower speeds and stopping rotation of the output shaft 27, a comparator 39 for determining whether the height of the seaming head 2 as detected by the position detector 36 is equal to the preset position, and a selector control unit 40 for controlling the rotational direction and speed of the output shaft 27 of the motor 24 depending on an output signal from the comparator 39. The controller 22 is in the form of an electric control circuit.

The position setting unit 35 can preset a predetermined seaming position Ho, a first height or vertical position $H_1$ which is higher than the predetermined seaming position Ho, a second height or vertical position $H_2$ which is higher than the first height $H_1$ and in which the seaming chuck 9 and the seaming roll 10 can be set in place, i.e., mounted, on the seaming head 2, a third height or vertical position Ho which is lower than the second height $H_2$ and higher than the predetermined height Ho, and a fourth height Hd which is lower than the predetermined height Ho. The position setting unit 35 erasably stores data on preset heights or vertical positions, and outputs signals representing the data to the comparator 39.

The position detector 36 calculates a position signal, indicative of the height or vertical position of the seaming head 2, from the output signal from the rotary encoder 26, and applies the position signal to the comparator 39 where it is compared with the signals of the preset position data from the position setting unit 35.

The comparator 39 compares the position signal from the position detector 36 with the signals of the preset position data from the position setting unit 35, and outputs a signal to the selector control unit 40 each time the detected height or position is equal to one of the preset positions, i.e., one of the preset positions is detected.

The rotational direction selector 37 is initially set to reverse the motor 24, i.e., to rotate the rotors 12 in a direction to lift the seaming head 2, at the start of the seaming head lifting and lowering apparatus 3. Then, in response to an output signal from the selector control unit 40, the rotational direction selector 37 changes the direction of a current supplied to the motor 24 to rotate the motor 24 in the normal direction, i.e., to rotate the rotors 12 in a direction to lower the seaming head 2. Subsequently, the selector control unit 40 applies an output signal to change the direction of the supplied current to reverse the motor 24 again, i.e., to rotate the rotors 12 to lift the seaming head 2.

The rotational speed selector 38 either selects a higher rotational speed or a lower rotational speed for the motor 24 or stops or de-energizes the motor 24. The rotational speed selector 38 initially energizes the motor 24 to rotate at the higher speed at the start of the seaming head lifting and lowering apparatus 3.

The selector control unit 40 controls the rotational direction selector 37 and the rotational speed selector 38 to energize the motor 24 when an automatic-return-type start switch 41 is turned on. In response to an output signal from the comparator 39, indicating that the first preset height $H_1$ is detected, the selector control unit 40 causes the rotational speed selector 38 to rotate the motor 24 at the lower speed. In response to an output signal from the comparator 39, indicating that the second preset height $H_2$ is detected, the selector control unit 40 causes the rotational speed selector 38 to de-energize the motor 24, and at the same time actuates the brake 34 to stop the rotation of the motor 24. When the start switch 41 is turned on again, the selector control unit 40 enables the rotational direction selector 37 to rotate the motor 24 in the normal direction, and also enables the rotational speed selector 38 to rotate the motor 24 at the higher speed. In response to an output output signal from the comparator 39, indicating that the third preset height Ho is detected, the selector control unit 40 causes the rotational speed selector 38 to rotate the motor 24 at the lower speed. In response to an output output signal from the comparator 39, indicating that the fourth preset height Hd is detected, the selector control unit 40 causes the rotational speed selector 38 to de-energize the motor 24, and at the same time actuates the brake 34 to stop the rotation of the motor 24.

When the start switch 41 is subsequently turned on, the selector control unit 40 causes the rotational direction selector 37 to rotate the motor 24 in the reverse direction and also causes the rotational speed selector 38 to rotate the motor 24 at the lower speed. In response to an output output signal from the comparator 39, indicating that the predetermined seaming height or position Ho is detected, the selector control unit 40 causes the rotational speed selector 38 to de-energize the motor 24, and at the same time actuates the brake 34 to stop the rotation of the motor 24.

Operation of the seaming head lifting and lowering apparatus 3 of the can end double-seaming machine will now be described below with reference to FIGS. 1, 3, and 4.

Figure 3:
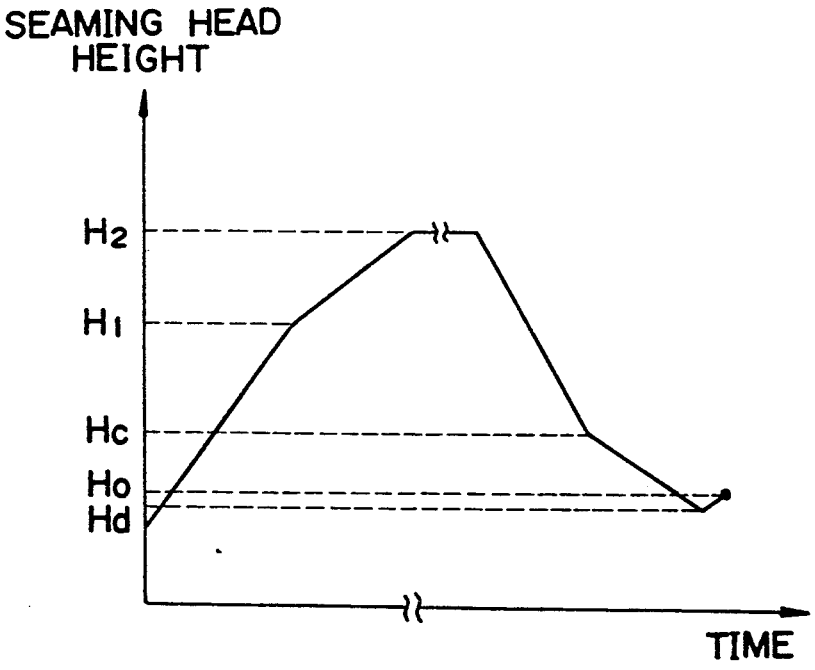
FIG. 3 is a diagram illustrative of the manner in which the apparatus operates.

FIG. 3 shows the height or vertical position of the seaming head 2 as it varies with time while the seaming head 2 is being vertically moved by the seaming head lifting and lowering apparatus 3.

In order to set the seaming chuck 9 and the seaming roll 10 on the seaming head 2, the motor 24 is energized to lift the seaming head 2 as indicated by the imaginary lines in FIG. 1. At this time, the controller 22 energizes the motor 24 to rotate at the higher speed and then to rotate at the lower speed until the seaming head 2 is elevated to the height $H_2$ where the seaming chuck 9 and the seaming roll 10 can be set in place on the seaming head 2.

Figure 4:
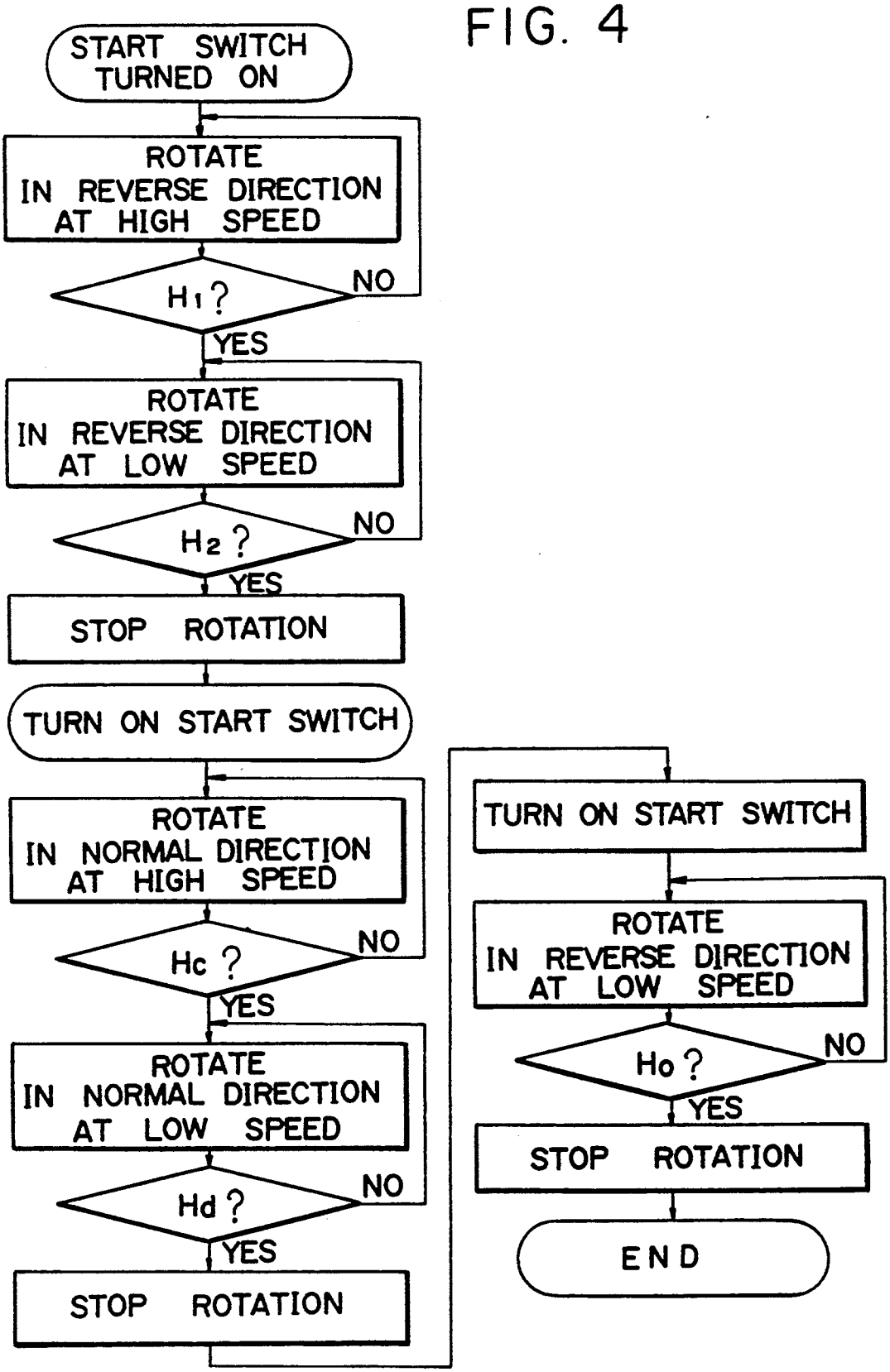
FIG. 4 is a flowchart of an operation sequence of the apparatus.

More specifically, as shown in FIG. 4, when the start switch 41 is turned on, the selector control unit 40 causes the rotational direction selector 37 and the rotational speed selector 38 to rotate the motor 24 in the reverse direction at the higher speed, thereby lifting the seaming head 2. When the first height $H_1$ is detected by the position detector 36 and the position setting unit 35 through the comparator 39, the selector control unit 40 enables the rotational speed selector 38 to rotate the motor 24 at the lower speed, further elevating the seaming head 2. When the second height $H_2$ is detected by the position detector 36 and the position setting unit 35 through the comparator 39, the selector control unit 40 causes the rotational speed selector 38 and the brake 34 to stop the rotation of the motor 24.

With the seaming head 2 kept at the height H2, the seaming check 9 and the seaming roll 10 are set in place on the seaming head 2. Thereafter, the seaming head 2 is lowered by the actuator assembly 21. That is, the controller 22 lowers the seaming head 2 at the higher speed until the seaming head 2 reaches the third height Hc (Ho<Hc) immediately prior to the predetermined seaming position Ho.

More specifically, when the start switch 41 is turned on, the selector control unit 40 causes the rotational direction selector 37 to rotate the motor 24 in the normal direction, and also causes the rotational speed selector 38 to rotate the motor 24 at the higher speed, thus lowering the seaming head 2. At the time the third height Hc is detected by the position detector 36 and the position setting unit 35 through the comparator 39, the selector control unit 40 causes the rotational speed selector 38 to rotate the motor 24 at the lower speed.

After the seaming head 2 starts to move downwardly at the lower speed, the controller 22 continuously lowers the seaming head 2 until it reaches the fourth height Hd (Hd<Ho) which is lower than the predetermined seaming position Ho.

When the fourth height Hd is detected by the position detector 36 and the position setting unit 35 through the comparator 39, the selector control unit 40 causes the rotational speed selector 38 and the brake 34 to stop the rotation of the motor 24.

Then, the actuator assembly 21 is controlled to elevate the seaming head 2 at the lower speed from the height Hd to the predetermined seaming position or height Ho until finally the seaming head 2 is stopped and positioned at the height Ho.

More specifically, when the start switch 41 is turned on again, the selector control unit 40 causes the rotational direction selector 37 to rotate the motor 24 in the reverse direction, and also causes the rotational speed selector 38 to rotate the motor 24 at the lower speed, thus lifting the seaming head 2. Upon detection of the seaming position Ho by the position detector 36 and the position setting unit 35 through the comparator 39, the selector control unit 40 causes the rotational speed selector 38 and the brake 34 to stop the rotation of the motor 24.

In the above embodiment, the seaming head 2 reaches the first and second heights $H_1$, $H_2$ when it is lifted. However, the first height $H_1$ may not necessarily be required, and the seaming head 2 may be lifted at the higher speed up to the second height $H_2$.

The seaming check 9 and the seaming roll 10 are set in place on the seaming head 2 at the second height $H_2$ to which it has been elevated. When the seaming head 2 is thereafter lowered from the height $H_2$ to the seaming position Ho, the seaming head 2 is first lowered to the position Hd that is lower than the seaming position Ho, and then lifted back from the position Hd to the seaming position Ho where the seaming head 2 is stopped. Therefore, the seaming head 2 can reliably be positioned in the predetermined seaming position Ho without an undesirable positional deviation or error which would otherwise result from the backlash between the threaded end portions 8, 13.

If the seaming head 2 were stopped directly in the predetermined seaming position Ho in its downward movement without going to the fourth position Hd, the seaming head 2 would not accurately be positioned in the seaming position Ho. More specifically, when the seaming head 2 descends, the threaded end portions 13 of the rotors 12 rotate and move downwardly in the respective threaded holes 7 in the support posts 6, while the threads of the threaded end portions 13 are engaging the immediately above threads of the threaded holes 7, but are slightly lifted off the immediately lower threads of the threaded holes 7 on account of the backlash between the threaded end portions 8, 13. If the rotors 12 were stopped to hold the seaming head 2 on its descent, the seaming head 2 would be displaced slightly downwardly due to gravity until the threads of the threaded end portions 13 rest on the immediately lower threads of the threaded holes 7 because of the backlash between the threaded end portions 8, 13.

According to the present invention, the seaming head 2 is once lowered to the position Hd that is lower than the predetermined seaming position Ho and then elevated back to the seaming position Ho, as described above. The seaming head 2 is deliberately displaced downwardly due to gravity, absorbing the backlash in the position Hd, and then goes to the seaming position Ho without the backlash. Therefore, when the seaming head 2 arrives at the seaming position Ho on its ascent, it does not suffer any positional error that would be caused by the backlash.

In the above embodiment, the seaming head lifting and lowering apparatus is incorporated in the can end double-seaming apparatus which double-seams can ends on filled can bodies. However, the principles of the present invention are also applicable to can end double-seaming apparatus for double-seaming can ends on empty can bodies.

With the present invention, as described above, the seaming head is vertically moved when the rotors vertically movable with the seaming head and threadedly engaging the support posts are rotated by the actuator assembly. When the seaming head is lowered from the elevated position in order to reach the predetermined seaming position, the actuator assembly is controlled by the controller to lower the seaming head to the position that is lower than the seaming position and then to lift the seaming head back to the seaming position where the seaming head is stopped. The seaming head can accurately be positioned in the seaming position without any positional error that would otherwise be induced by the backlash between the threaded portions of the rotors and the support posts. Consequently, the seaming head can reliably and accurately be brought into the seaming position.

The vertical movement and positioning of the seaming head, which is controlled by the controller in the form of an electric circuit, is easily automatized to reduce the time required to position the seaming chuck and the seaming roll for double-seaming operation.

Although a certain preferred embodiment has been shown and described, it should be understood that many changes and modifications may be made therein without departing from the scope of the appended claims.

What is claimed is:

1. An apparatus for lifting and lowering a seaming head in a can end seaming machine which includes a base on which the seaming head is vertically movably mounted, the seaming head supporting a seaming chuck, a support post mounted on the base for guiding the seaming head, and a rotor rotatably threaded on the support post and rotatable for lifting and lowering the seaming head, said apparatus comprising:

actuating means for rotating said rotor to lift and lower the seaming head; and controlling means for controlling said actuating means to elevate the seaming head upwardly of a predetermined seaming position, then lower the seaming head downwardly of said seaming position, and thereafter elevate the seaming head to said seaming position, thereby positioning the seaming head in said seaming position.

2. An apparatus according to claim 1, wherein said controlling means comprises means for controlling said actuating means to elevate the seaming head to a first position that is higher than said seaming position, then lower the seaming head at a higher speed from said first position to a second position that is higher than said seaming position, then lower the seaming head at a lower speed from said second position to a third position that is lower than said seaming position, and thereafter elevate the seaming head at a lower speed from said third position to said seaming position.

3. An apparatus according to claim 2, wherein said actuating means comprises a motor coupled to rotate said rotor, and brake means for braking said motor, and wherein said controlling means comprises position setting means for setting said first position, said second position, said third position, and said seaming position, position detecting means for detecting the vertical position of the seaming head, rotational direction selecting means for selectively rotating said motor and said rotor in a direction to elevate the seaming head and in a direction to lower the seaming head, rotational speed selecting means for selectively rotating said motor and said rotor at the higher and lower speeds, comparing means for comparing the detected vertical position of the seaming head with said first, second, third, and seaming positions that have been set by said position setting means, and for producing an output signal each time said detected vertical position is equal to one of said first, second, third, and seaming positions, and selection control means responsive to said output signal from said comparing means, for enabling said rotational direction selecting means and said rotational speed selecting means to rotate said motor and said rotor at a selected one of said higher and lower speeds in a selected one of said directions.

4. An apparatus according to claim 3, wherein said position detecting means comprises means for detecting the vertical position of the seaming head depending on an angular displacement of the rotor.

5. An apparatus according to claim 1, wherein said support post has an internally threaded hole defined vertically therein, said rotor having an externally threaded end portion rotatably threaded in said internally threaded hole, said rotor having an opposite end portion, the seaming head being supported on said opposite end portion of said rotor by a bearing.

* * * * *